US007146881B2

(12) United States Patent
Chang

(10) Patent No.: US 7,146,881 B2
(45) Date of Patent: Dec. 12, 2006

(54) WRENCH HAVING A LOCKING DEVICE WITH A SMALLER DRIVING ANGLE

(75) Inventor: Chuck Chang, Taichung (TW)

(73) Assignee: Lotuskate Sports Industrial Co., Ltd., Taichung (TW)

( * ) Notice: Subject to any disclaimer, the term of this patent is extended or adjusted under 35 U.S.C. 154(b) by 0 days.

(21) Appl. No.: 11/246,079

(22) Filed: Oct. 11, 2005

(65) Prior Publication Data

US 2006/0070497 A1 Apr. 6, 2006

Related U.S. Application Data

(63) Continuation-in-part of application No. 10/382,531, filed on Mar. 7, 2003, now abandoned.

(51) Int. Cl.
*B25B 13/46* (2006.01)

(52) U.S. Cl. ..... 81/62; 81/63.1

(58) Field of Classification Search ..... 81/60, 81/62, 63.1

See application file for complete search history.

(56) References Cited

U.S. PATENT DOCUMENTS 4,423,649 A 1/1984 Junkers et al.
5,537,899 A 7/1996 Diedrich
5,782,147 A 7/1998 Chaconas et al.
5,960,680 A 10/1999 Chen et al.
6,101,902 A 8/2000 Wei
6,305,247 B1 10/2001 Chen
6,457,386 B1 10/2002 Chiang
6,629,477 B1 10/2003 Ling et al.

*Primary Examiner*—David B. Thomas
(74) *Attorney, Agent, or Firm*—Rosenberg, Klein & Lee

(57) ABSTRACT

A wrench includes a drive head, a drive member, a plurality of locking teeth mounted on either one of the inner wall of the drive head and the drive member, and two locking devices located beside the drive member. An urging block is located between the two locking devices for pressing one of the two locking devices to engage with the drive member. Each of the locking devices includes two driving blocks each formed with a locking end engageable with the locking teeth to drive the drive member. The locking ends of the two driving blocks are respectively engaged with the locking teeth at different time. Thus, the locking device has a smaller driving angle for driving the drive member.

5 Claims, 6 Drawing Sheets

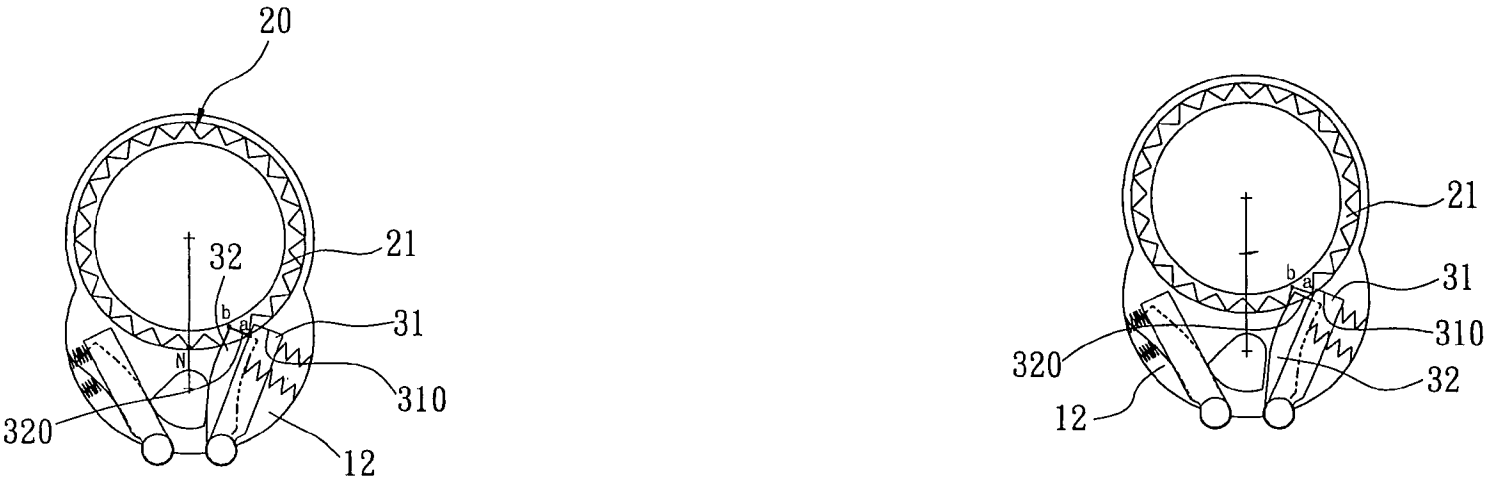
FIG. 5
FIG. 5A
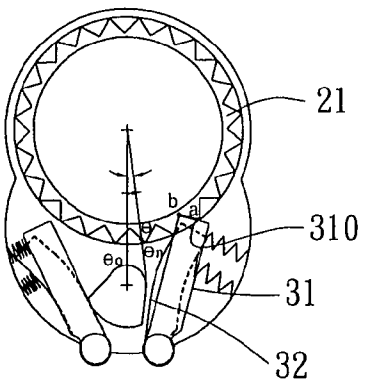
FIG. 5B
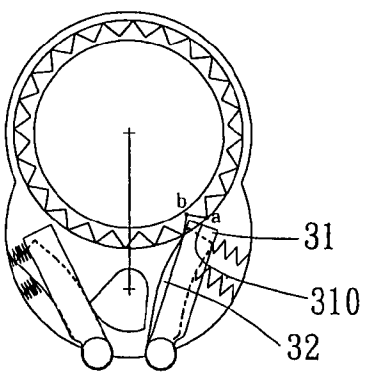
FIG. 5C

WRENCH HAVING A LOCKING DEVICE WITH A SMALLER DRIVING ANGLE

BACKGROUND OF THE INVENTION

1. Field of the Invention

This is a Continuation-In-Part application of applicant's former patent application with application Ser. No. 10/382,531, filed on Mar. 7, 2003 now abandoned.

2. Description of the Related Art

A first conventional ratchet wrench 90 in accordance with the prior art shown in FIG. 19 comprises a drive head 92 formed with a receiving recess 920 and a driving recess 921 located beside the receiving recess 920, a ratchet wheel 93 mounted in the receiving recess 920, two locking blocks 95 mounted in the driving recess 921, an urging block 94 mounted in the driving recess 921 and urged on one of the two locking blocks 95, two restoring members 96 mounted in the driving recess 921 and urged on a respective one of the two locking blocks 95, and a direction control knob 940 pivotably mounted on the drive head 92 and connected to the urging block 94 for rotating the urging block 94 to control the driving direction of the two locking blocks 95. However, the locking blocks 95 of the first conventional ratchet wrench 90 do not have a smaller driving angle.

A second conventional ratchet wrench 90A in accordance with the prior art shown in FIG. 20 comprises a drive head 92A having an inner wall formed with a plurality of locking teeth 920A, a drive member 93A mounted in the drive head 92A, and a locking block 95A pivotally mounted in the drive member 93A and engaged with the locking teeth 920A of the drive head 92A. However, the locking block 95A of the second conventional ratchet wrench 90A do not have a smaller driving angle.

U.S. Pat. No. 6,457,386 to Chiang discloses a ratchet wrench that includes a complicated structure having a control member 26 having a pillar 262 and a press disk 261 on the pillar 26, the pillar 262 includes a plurality of circular holes 263 for receiving compression springs S2 and the corresponding balls R. The chamber 231 of the drive member 23 has two annular gears 27, 27' which respectively enclose one of the first pawls 24 and one of the second pawls 25. The pillar is located at a center of the drive head of the wrench and a bevel gear 221 is connected on a top end of the drive shaft 22. The first and second pawls are engaged with the annular gears by the outer teeth 241 and one-side serrations 251 which are located at an inner position and enclosed by the annular gears. The number of parts makes the assembling processes to be extremely time-consuming and the parts include many different sizes and shapes which increase the manufacturing cost.

SUMMARY OF THE INVENTION

The primary objective of the present invention is to provide a wrench wherein the locking device includes at least two composite driving blocks having different lengths to lock and drive the drive member at different angles, so that the locking device has a smaller driving angle for driving the drive member, thereby enhancing the torque of the wrench with a smaller driving angle.

Another objective of the present invention is to provide a wrench having a simplified construction without having to changing the structure of the drive member, the drive head and the direction control knob, thereby decreasing costs of fabrication and maintenance.

A further objective of the present invention is to provide a wrench, wherein provision of the locking device does not affect the structural strength of the wrench, thereby enhancing the structural strength of the wrench.

In accordance with the present invention, there is provided a wrench which comprises a drive head with a drive member received therein and a plurality of locking teeth are defined in an outer wall of the drive head. An urging block is mounted in a driving recess in the drive head and a direction control knob is connected to the urging block for rotating the urging block. Two locking devices are mounted in the driving recess and located beside the drive member. The urging block is located between the two locking devices so that the urging block presses one of the locking devices by operating the direction control knob. Each of two locking devices includes two independent driving blocks laminating each other. Each of the two driving blocks is formed with a locking end and a positioning portion. The locking end is engageable with the locking teeth and the locking ends of the two driving blocks are respectively engaged with the locking teeth at different time.

Further benefits and advantages of the present invention will become apparent after a careful reading of the detailed description with appropriate reference to the accompanying drawings.

BRIEF DESCRIPTION OF THE DRAWINGS

FIG. 5 is a top plan operational view of the wrench as shown in FIG. 2;

FIG. 5A is a schematic operational view of the wrench as shown in FIG. 5 in use;

FIG. 5B is a schematic operational view of the wrench as shown in FIG. 5A in use;

FIG. 5C is a schematic operational view of the wrench as shown in FIG. 5B in use.

DETAILED DESCRIPTION OF THE INVENTION

Figure 1:
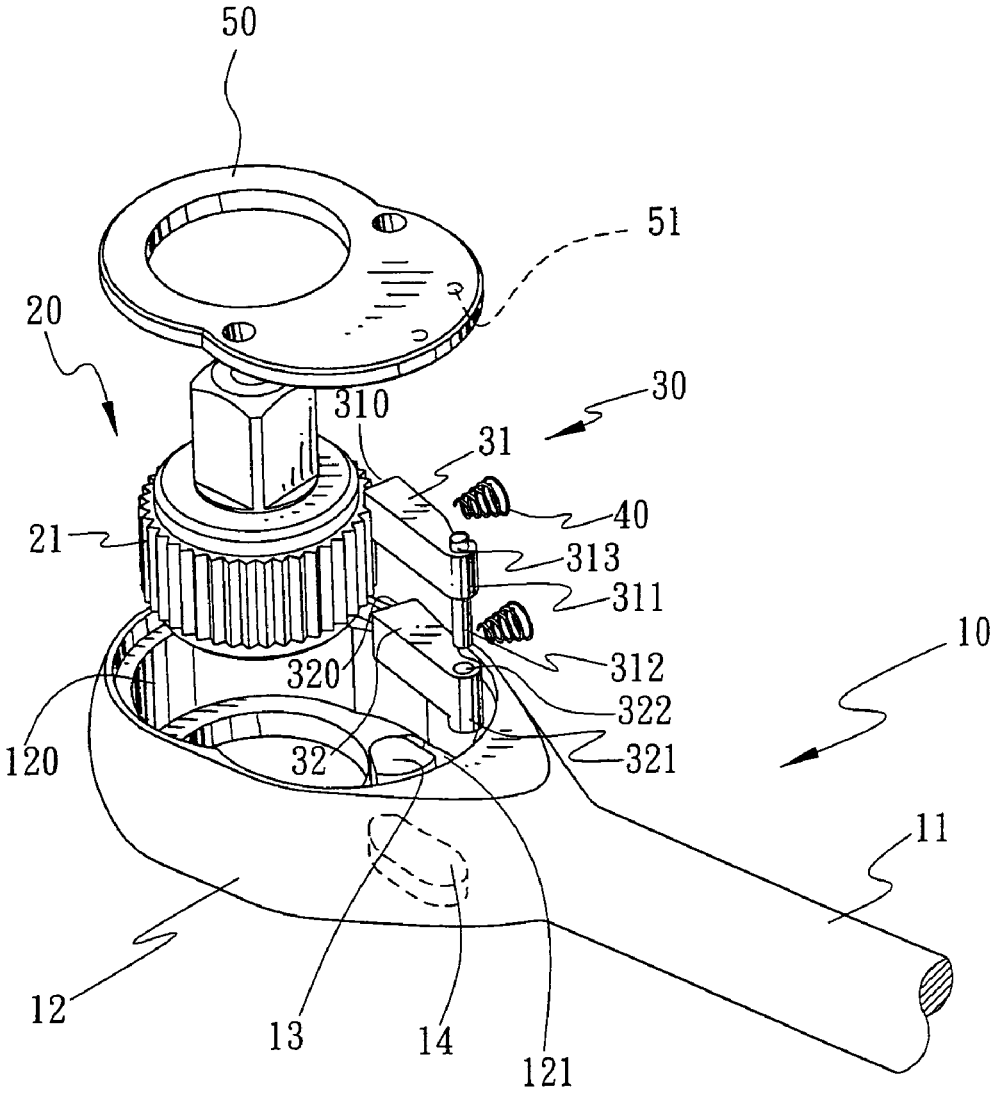
FIG. 1 is an exploded perspective view of the wrench in accordance with the first embodiment of the present invention.
Figure 2:
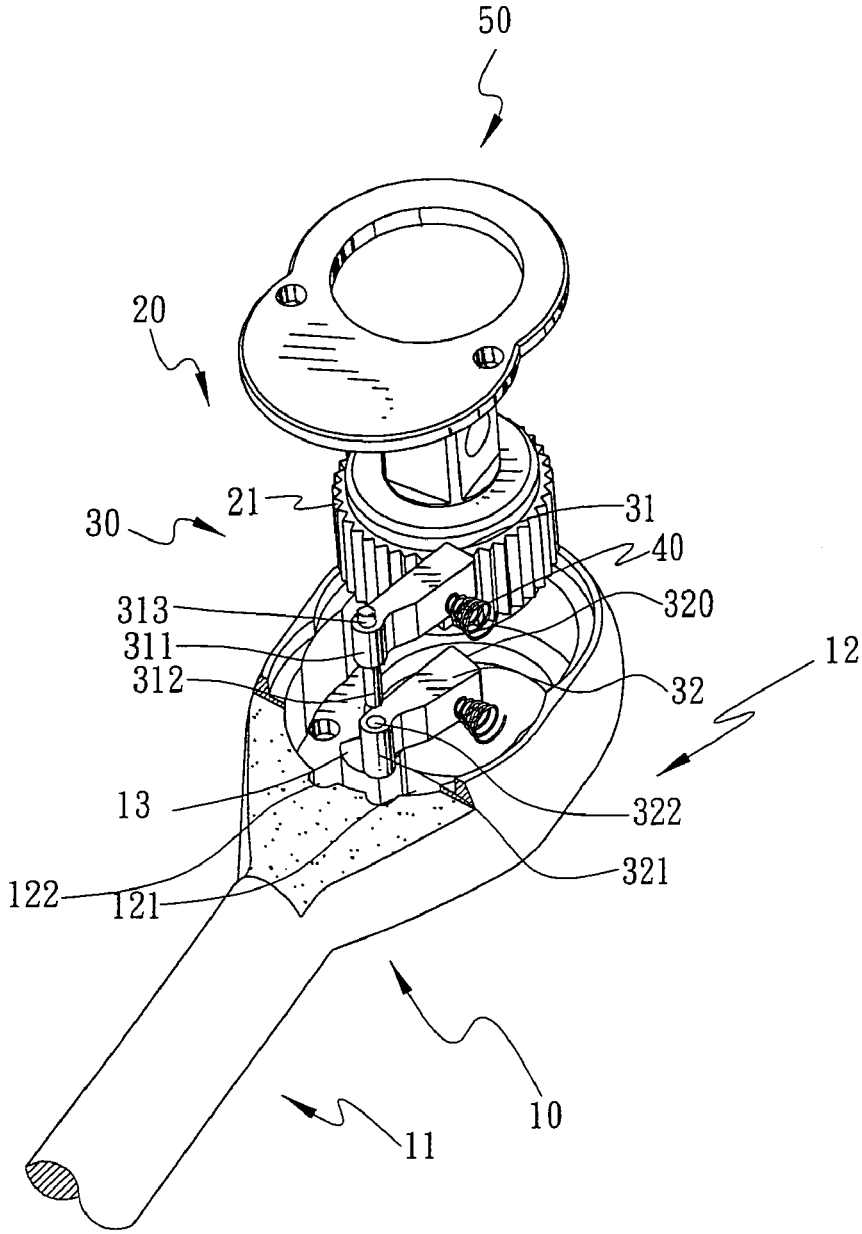
FIG. 2 is an exploded perspective view of the wrench in accordance with the first embodiment of present invention.
Figure 3:
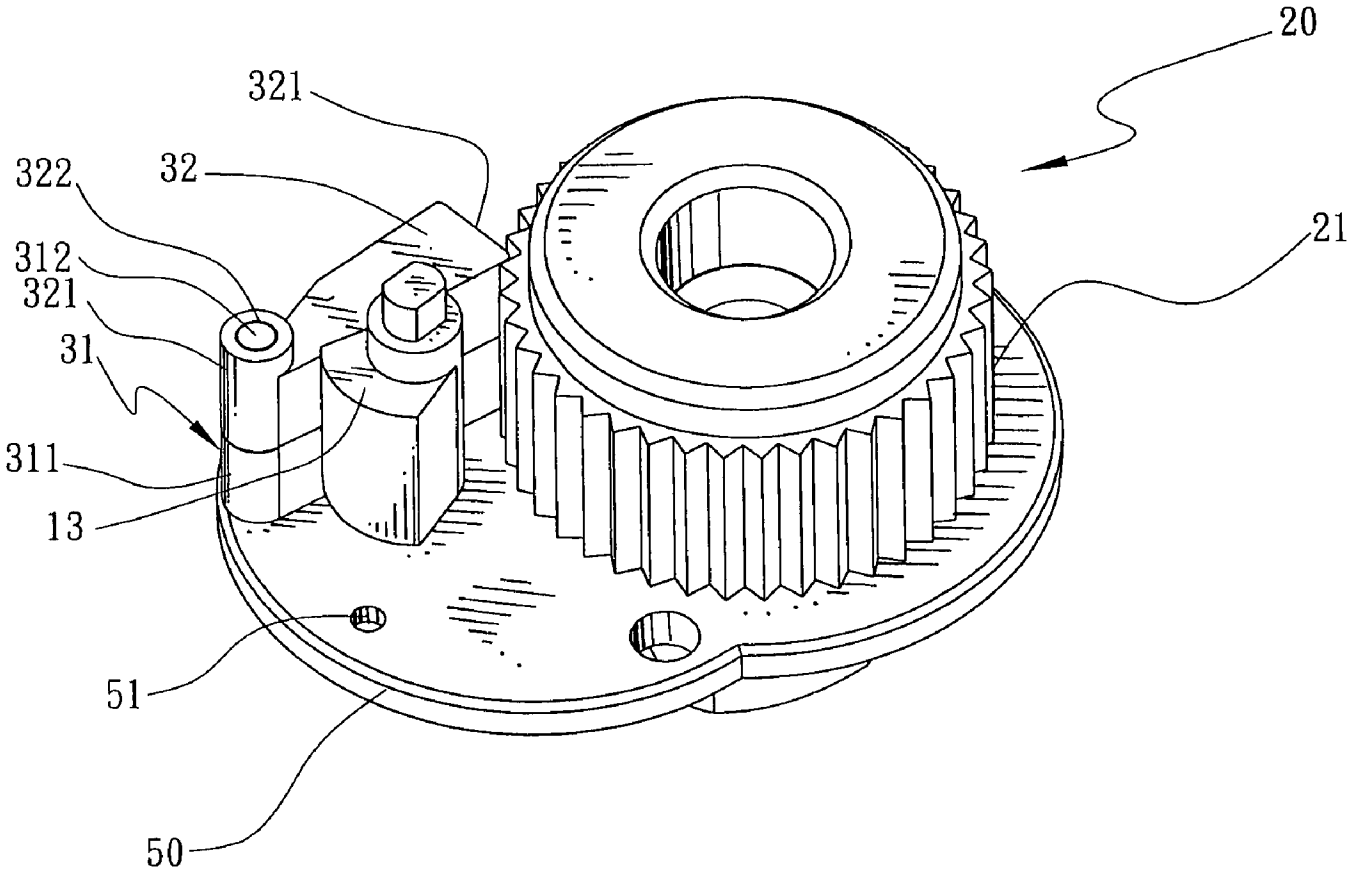
FIG. 3 is a bottom perspective assembly view of the wrench in accordance with the first embodiment of the present invention.

Referring to the drawings and initially to FIGS. 1–4 a wrench 10 in accordance with a first embodiment of the present invention comprises a shank 11 having an end portion formed with a drive head 12 formed with a receiving recess 120 and a driving recess 121 located beside the receiving recess 120, a drive member 20 (such as a ratchet wheel) mounted in the receiving recess 120 and having an outer wall formed with locking teeth 21, an urging block 13 mounted in the driving recess 121, two locking devices 30 mounted in the driving recess 121 and located beside the drive member 20, the urging block 13 located between the two locking devices 30, a plurality of restoring members 40

(such as springs) mounted in the driving recess 121 and urged on the locking device 30, a direction control knob 14 pivotably mounted on the drive head 12 and connected to the urging block 13 for rotating the urging block 13, and a cover 50 mounted in a top of the receiving recess 120 to cover the drive head 12.

The locking device 30 is located on each of two sides of the urging block 13 and includes a first driving block 31 and a second driving block 32 laminating each other;

Each of the first driving block 31 and the second driving block 32 has a first end formed with a locking end 310 and 320 engaged with the locking teeth 21 of the drive member 20. The locking end 310 of the first driving block 31 is protruded out ward from the locking end 320 of the second driving block 32 with a length difference equal to a half of the tooth pitch of the locking teeth 21 of the drive member 20.

Each of the first driving block 31 and the second driving block 32 has a second end formed with a cylindrical positioning portion 311 and 321. The two positioning portions 311 and 321 are co-axial and are rotatably mounted in an arcuate positioning recess 122 in the driving recess 121. The positioning portion 321 of the second driving block 32 has a bottom locked on a bottom of the driving recess 121.

The positioning portion 321 of the second driving block 32 is formed with a pivot hole 322. The positioning portion 311 of the first driving block 31 has a bottom formed with a protruding pivot portion 312 pivotally mounted in the pivot hole 322 of the second driving block 32.

The cover 50 has a bottom formed with two mounting holes 51. The positioning portion 311 of the first driving block 31 has a top formed with a protruding mounting portion 313 mounted in one of the two mounting holes 51 of the cover 50.

Each of the restoring members 40 is urged between each of the first driving block 31 and the second driving block 32 of the locking device 30 and the wall of the driving recess 121.

Figure 4:
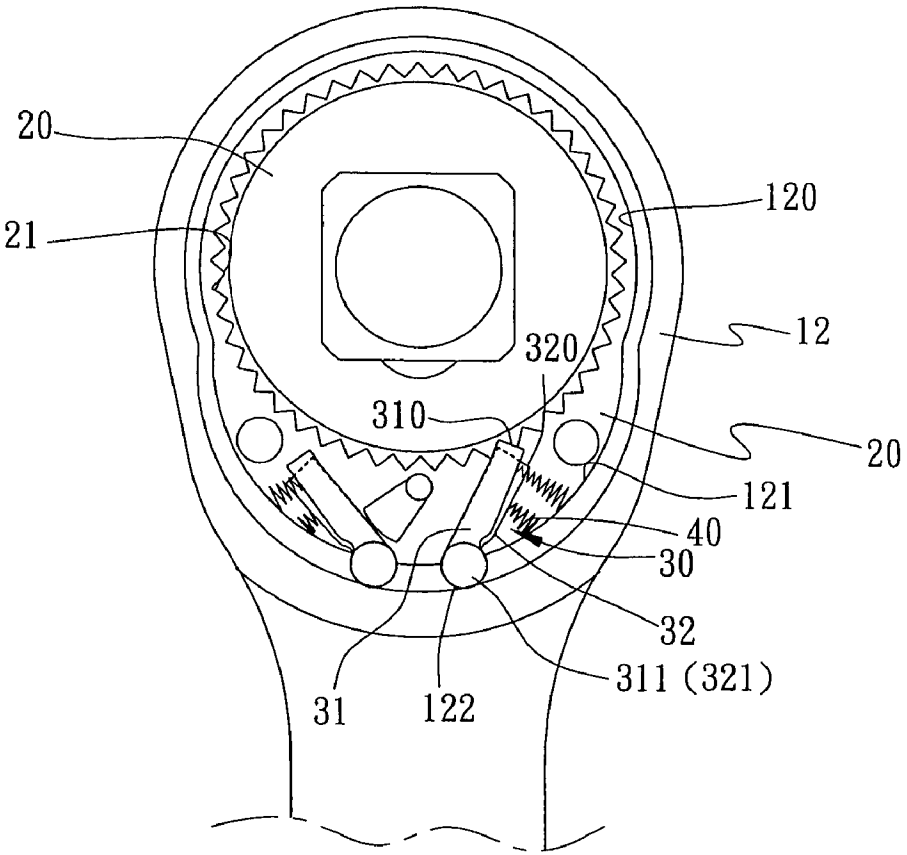
FIG. 4 is a top plan assembly view of the wrench as shown in FIG. 2.

In assembly, the locking device 30 located on one of the two sides of the urging block 13 is pressed by the urging block 13 as shown in FIG. 4, so that only one of the two locking devices 30 is engaged with the drive member 20. In such a manner, when the drive head 12 is rotated, only one of the two locking devices 30 is driven to rotate the drive member 20 for rotating a workpiece (not shown) or a socket (not shown) in the clockwise or counterclockwise direction. Thus, the driving direction of the wrench 10 can be controlled by pivoting the urging block 13.

In addition, the locking end 310 of the first driving block 31 is protruded outward from the locking end 320 of the second driving block 32, so that only one of the locking end 310 of the first driving block 31 and the locking end 320 of the second driving block 32 of the locking device 30 is engaged with the locking teeth 21 of the drive member 20 for driving the drive member 20.

In operation, referring to FIG. 5 with reference to FIGS. 1–4, when the locking device 30 is driven to rotate the drive member 20 for rotating the workpiece or the socket, the locking end 320 of the second driving block 32 is locked on the tooth root "b" of one of the locking teeth 21 of the drive member 20 for driving the drive member 20. When the operation space of the wrench 10 is limited, the drive head 12 has to be rotated backward.

When the drive head 12 is rotated from the position as shown in FIG. 5 to the position as shown in FIG. 5A, the rotation distance is smaller than a half of the tooth pitch of the locking teeth 21 of the drive member 20, so that the locking end 320 of the second driving block 32 is detached from the tooth root "b" of one of the locking teeth 21 of the drive member 20, while the locking end 310 of the first driving block 31 is rested on the tooth tip "a" of one of the locking teeth 21 of the drive member 20.

When the drive head 12 is rotated form the position as shown in FIG. 5A to the position as shown in FIG. 5B, the locking end 310 of the first driving block 31 is detached from the tooth tip "a" of one of the locking teeth 21 of the drive member 20 and is locked on the tooth root "b" of one of the locking teeth 21 of the drive member 20. At this time, when the drive head 12 is rotated forward again, the locking end 310 of the first driving block 31 (instead of the locking end 320 of the second driving block 32) is locked on the tooth root "b" of one of the locking teeth 21 of the drive member 20 for driving the drive member 20.

When the drive head 12 is rotated from the position as shown in FIG. 5B to the position as shown in FIG. 5C, the locking end 310 of the first driving block 31 is detached form the tooth root "b" of one of the locking teeth 21 of the drive member 20, while the locking end 320 of the second driving block 32 is rested on the tooth tip of another one of the locking teeth 21 of the drive member 20.

When the drive head 12 is rotated form the position as shown in FIG. 5C to the position as shown in FIG. 5, the locking end 320 of the second driving block 32 is detached from the tooth tip of another one of the locking teeth 21 of the drive member 20 and is locked on the tooth root of another one of the locking teeth 21 of the drive member 20. At this time, when the drive head 12 is rotated forward again, the locking end 320 of the second driving block 32 (instead of the locking end 310 of the first driving block 31) is locked on the tooth root of another one of the locking teeth 21 of the drive member 20 for driving the drive member 20.

Thus, the locking end 310 of the first driving block 31 and the locking end 320 of the second driving block 32 are located at the same locking tooth 21 of the drive member 20, and only one of the first driving block 31 and the second driving block 32 is acted on the drive member 20, so that the locking device 30 has a smaller driving angle for driving the drive member 20.

Accordingly, the wrench 10 in accordance with the present invention has the following advantages.

1. The locking device 30 includes at least two composite driving blocks having different lengths to lock and drive the drive member 20 at different angles, so that the locking device 30 has a smaller driving angle for driving the drive member 20, thereby enhancing the torque of the wrench 10 with a smaller driving angle.

2. The wrench 10 has a simplified construction without having to changing the structure of the drive member 20, the drive head 12 and the direction control knob 14, thereby decreasing costs of fabrication and maintenance.

3. Provision of the locking device 30 does not affect the structural strength of the wrench 10, thereby enhancing the structural strength of the wrench 10.

Figure 6:
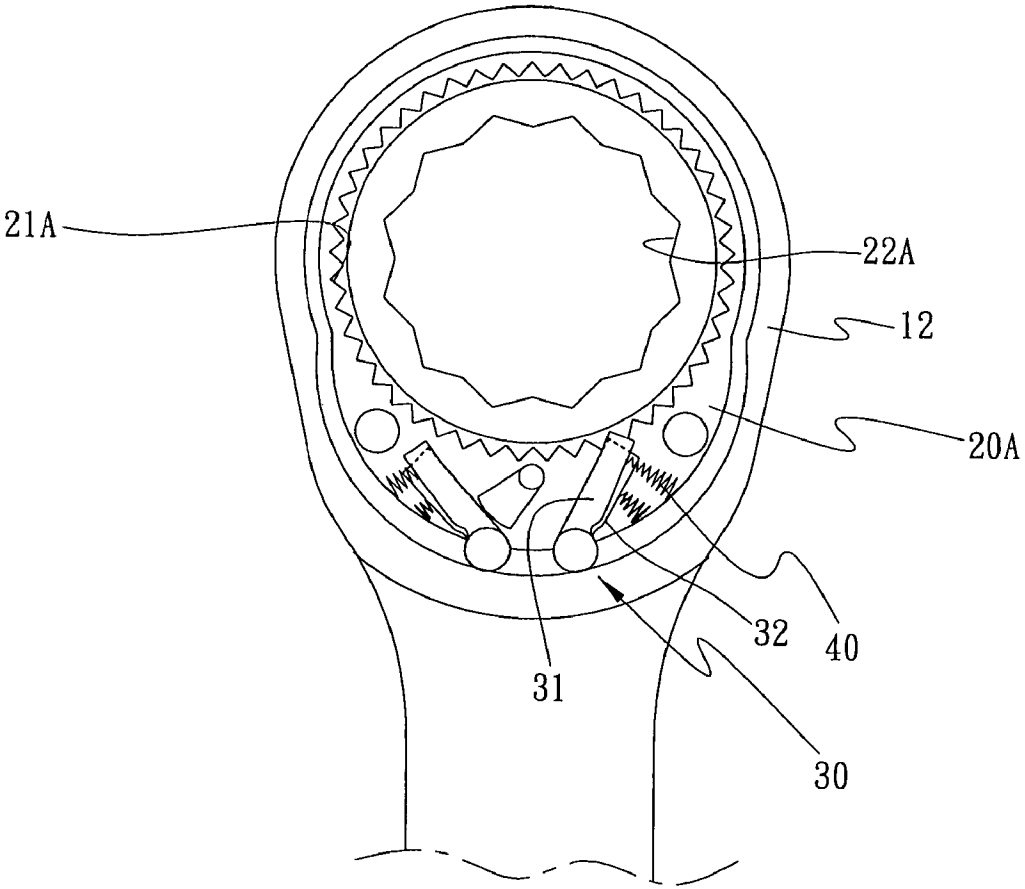
FIG. 6 is a top plan assembly view of the wrench in accordance with another embodiment of the present invention.

Referring to FIG. 6, in accordance with another embodiment of the present invention, the drive member 20A has an outer wall formed with locking teeth 21A and an inner wall formed with a polygonal driving recess 22A.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench, comprising:

a drive head;

a drive member mounted in an inner wall of the drive head;

a plurality of locking teeth defined in an outer wall of the drive head and the drive member;

an urging block mounted in a driving recess in the inner wall of the drive head and a direction control knob pivotably mounted on the drive head and connected to the urging block for rotating the urging block, and two locking devices mounted in the driving recess and located beside the drive member, the urging block located between the two locking devices so that the urging block presses one of the locking devices by operating the direction control knob, each of two locking devices including two independent driving blocks laminating each other, each of the two driving blocks formed with a locking end and a positioning portion, the locking end engageable with the locking teeth, the locking ends of the two driving blocks are respectively engaged with the locking teeth at different time.

2. The wrench in accordance with claim 1, wherein the locking ends of each of the two driving blocks have different lengths.

3. The wrench in accordance with claim 1, wherein the locking end of a first one of the two driving blocks is protruded outward form the locking end of a second one of the two driving blocks with a length difference equal to a half of the tooth pitch of each of the locking teeth.

4. The wrench in accordance with claim 1, further comprising at least one restoring member urged between each of the locking devices and the inner wall of the drive head.

5. The wrench in accordance with claim 1, wherein each of the driving blocks includes a positioning portion and the respective positioning portions of the driving blocks are co-axial and are rotatably mounted in an arcuate positioning recess in the inner wall of the drive head.

* * * * *